US009008543B2

(12) United States Patent
Hashimoto et al.

(10) Patent No.: US 9,008,543 B2
(45) Date of Patent: Apr. 14, 2015

(54) IMAGE FORMING APPARATUS

(71) Applicants: Haruo Hashimoto, Osaka (JP); Kaoru Tada, Osaka (JP); Kenji Nakamura, Osaka (JP)

(72) Inventors: Haruo Hashimoto, Osaka (JP); Kaoru Tada, Osaka (JP); Kenji Nakamura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/974,144

(22) Filed: Aug. 23, 2013

(65) Prior Publication Data

US 2014/0064781 A1 Mar. 6, 2014

(30) Foreign Application Priority Data

Aug. 29, 2012 (JP) ..... 2012-188952

(51) Int. Cl.

*G03G 15/00* (2006.01)
*G03G 21/16* (2006.01)
*G03G 21/18* (2006.01)

(52) U.S. Cl.

CPC ..... *G03G 21/1666* (2013.01); *G03G 21/1853* (2013.01); *G03G 21/1633* (2013.01); *G03G 21/1671* (2013.01)

(58) Field of Classification Search

CPC ..... G03G 21/1666; G03G 21/1853
USPC ..... 399/110, 118, 125; 347/138
See application file for complete search history.

(56) References Cited

U.S. PATENT DOCUMENTS

| | | | | |
|---|---|---|---|---|
| 5,978,626 | A * | 11/1999 | Nagamine et al. | 399/125 |
| 6,252,619 | B1 * | 6/2001 | Ueda et al. | 399/125 |
| 7,245,313 | B2 * | 7/2007 | Yamagata | 347/242 |
| 8,773,486 | B2 * | 7/2014 | Nakamura et al. | 347/238 |
| 2009/0202272 | A1 * | 8/2009 | Nakashima | 399/117 |
| 2012/0070189 | A1 * | 3/2012 | Okabe | 399/111 |
| 2013/0071139 | A1 * | 3/2013 | Fukao | 399/110 |
| 2013/0164033 | A1 * | 6/2013 | Okabe | 399/119 |
| 2013/0315625 | A1 * | 11/2013 | Fujita et al. | 399/125 |
| 2014/0044450 | A1 * | 2/2014 | Nakamura | 399/110 |

FOREIGN PATENT DOCUMENTS

| | | |
|---|---|---|
| JP | 2000-181165 | 6/2000 |
| JP | 2001-175046 | 6/2001 |
| JP | 2009-288596 | 12/2009 |

* cited by examiner

*Primary Examiner* — Ryan Walsh
(74) *Attorney, Agent, or Firm* — Harness, Dickey & Pierce, P.L.C.

(57) ABSTRACT

An image forming apparatus capable of preventing the image formation unit from being attached to a guide member for the image formation unit mistakenly, including an apparatus body; an image carrier including a rotary shaft; an exposure device configured to form a latent image through exposure of a surface of the image carrier and retractable from an exposure position; an image formation unit disposed detachably from the apparatus body; and a guide member to guide the exposure device to the exposure position. In the optimal apparatus, the guide member is used both to guide the image formation unit to the apparatus body and to guide the exposure device to the exposure position.

9 Claims, 5 Drawing Sheets

IMAGE FORMING APPARATUS

CROSS-REFERENCE TO RELATED APPLICATION

The present application claims priority pursuant to 35 U.S.C. §119 from Japanese patent application number 2012-188952, filed on Aug. 29, 2012, the entire disclosure of which is incorporated by reference herein.

BACKGROUND

1. Technical Field

The present invention relates to an image forming apparatus such as a copier, a printer, a facsimile machine, or a multi-function apparatus having one or more capabilities of the above devices.

2. Related Art

In an image forming apparatus employing an electrophotographic method, provision of an LED head in which light-emitting diodes are aligned is used as one type of exposure approach to form a latent image by emitting light onto a photoreceptor. Because the LED head is provided near the photoreceptor, if the photoreceptor or parts around the photoreceptor need to be replaced, the LED head will hinder the replacement operation of the photoreceptor.

Conceivably, replaceability could be improved by making the LED head retractable in a direction away from the photoreceptor.

For example, JP-3504170-B (JP-2000-181165-A) discloses an openably closable cover which is disposed above the image forming apparatus body and is integrally formed with the LED head. The thus-formed LED head can be retracted from a position near the photoreceptor as the cover is opened. Further, the same discloses that the image forming apparatus includes a guide groove extending vertically along an interior wall of the apparatus body. The LED head is moved along the guide groove and guided to a predetermined position.

However, because the guide groove to guide the LED head is disposed separately from a guide groove to attach and detach an image formation unit including the photoreceptor, there is a risk that the image formation unit is erroneously inserted into the guide groove for the LED head when the image formation unit is attached.

SUMMARY

The present invention provides an improved optimal image forming apparatus capable of preventing mistaken installation of an image formation unit in the apparatus, and includes an apparatus body; an image carrier including a rotary shaft; an exposure device; an image formation unit; and a guide member to guide the exposure device to an exposure position. The image carrier is configured to form a latent image through exposure of a surface of the image carrier and is retractable from the exposure position. The image formation unit is detachable from the apparatus body. The guide member is used both to guide the image formation unit to the apparatus body and to guide the exposure device to the exposure position.

These and other objects, features, and advantages of the present invention will become apparent upon consideration of the following description of the preferred embodiments of the present invention when taken in conjunction with the accompanying drawings.

DETAILED DESCRIPTION

Figure 1:
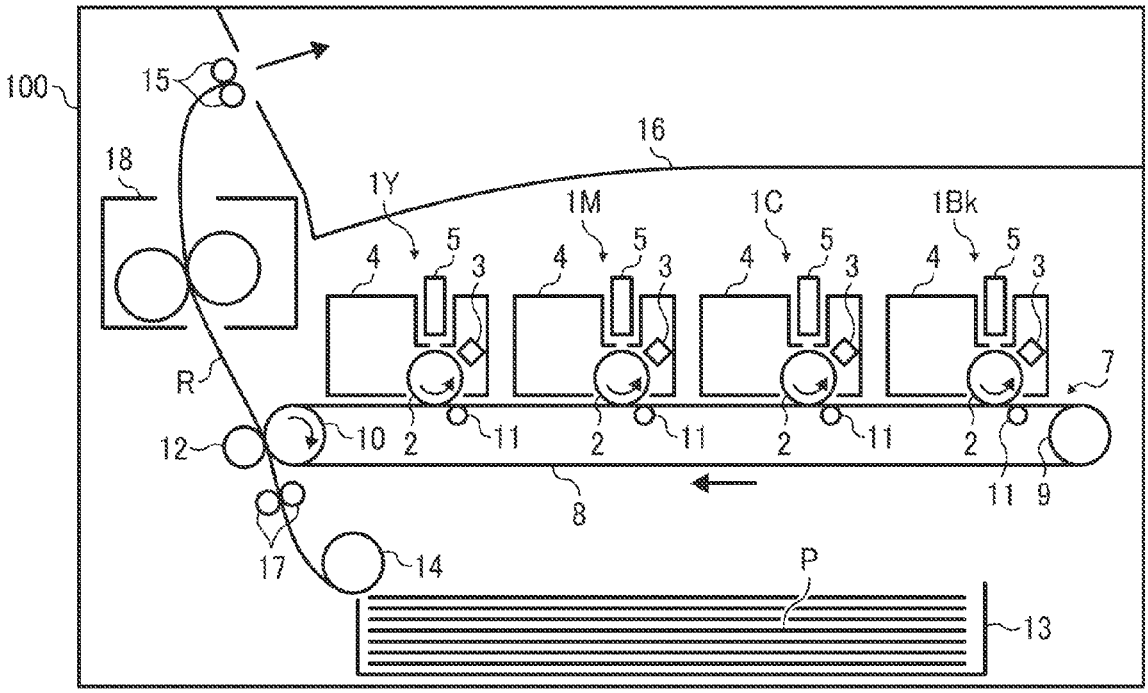
FIG. 1 shows a schematic configuration of a color laser printer as an image forming apparatus according to an embodiment of the present invention.

Hereinafter, the present invention will be described referring to the accompanying drawings. In each figure illustrating an embodiment of the present invention, parts or component having the same function or shape are given the same reference numerals, and once explained, a redundant description thereof will be omitted.

FIG. 1 shows a schematic configuration of a color laser printer as an image forming apparatus according to an embodiment of the present invention.

First, with reference to FIG. 1, basic operation of the printer according to an embodiment of the present invention will be described. It is to be noted, however, that the present invention is not limited to a printer but is applicable to monochrome printers, various types of copiers, facsimile machines, or multifunction apparatuses combining several of the functions of these devices.

As illustrated in FIG. 1, four processing units 1Y, 1M, 1C, and 1Bk each as an image formation unit are detachably attached to a printer body or an image forming apparatus body 100. Each of the processing units 1Y, 1M, 1C, and 1Bk has the same structure except that each employs a different color of toner, such as yellow (Y), magenta (M), cyan (C), and black (Bk), which corresponds to RCB color separation components of a color image.

Specifically, each of the processing units 1Y, 1M, 1C, and 1Bk includes a drum-shaped photoreceptor 2 as a latent image carrier (or an image carrier); a charger 3 to charge a surface of the photoreceptor 2; a fusing device 4 to render a latent image formed on the photoreceptor 2 visible; and a cleaner (not shown) to clean the surface of the photoreceptor 2, all of which together form a single processing unit.

In addition, a plurality of optical writing heads 5 (i.e., exposure means) to expose the surface of the photoreceptor 2 and form the latent image thereon is disposed in the vicinity of each photoreceptor 2. In the present embodiment, an LED array head in which light-emitting elements such as LEDs are aligned in the photoreceptor longitudinal direction is used; alternatively, however, an organic EL element may be used. In addition, a rod lens (not shown) to collect light is disposed at a light emitter to radiate laser beams to the photoreceptor 2 of each LED array head.

A transfer device 7 is disposed below each photoreceptor 2. The transfer device 7 includes an endless belt-shaped intermediate transfer belt 8. The intermediate transfer belt 8 is stretched around a drive roller 9, a driven roller 10, and a plurality of primary transfer rollers 11. Herein, when the drive roller 9 rotates in the clockwise direction, the intermediate transfer belt 8 is driven to rotate cyclically in a direction indicated by an arrow in the figure.

The four primary transfer rollers 11 each are disposed at a position opposed to the photoreceptor 2 via the intermediate transfer belt 8. Each primary transfer roller 11 presses an interior surface of the intermediate transfer belt 8 at each disposed position, and a primary transfer nip is formed at a position where the pressed portion of the intermediate transfer belt 8 contacts each photoreceptor 2. In addition, each primary transfer roller 11 is connected to a power source (not shown) and is supplied with a predetermined direct current (DC) voltage and/or alternating current (AC) voltage.

A secondary transfer roller 12 is disposed at a position opposed to the drive roller 9. The secondary transfer roller 12 presses against an external surface of the intermediate transfer belt 8 and a secondary transfer nip is formed at a position where the secondary transfer roller 12 contacts the intermediate transfer belt 8. In addition, similarly to the primary transfer rollers 11, the secondary transfer roller 12 is connected to the not-shown power source and is supplied with a predetermined direct current (DC) voltage and/or alternating current (AC) voltage.

A paper tray 13 to contain a plurality of sheets P of recording media and a sheet feed roller 14 to convey each sheet P from the paper tray 13 are disposed in the bottom of the apparatus body 100. Herein, the sheet P includes various types of sheets such as cardboard, postcards, envelopes, plain paper, thin paper, coated paper or art paper, tracing paper, and the like. In addition, an OHP sheet or film may be used as recording media.

On the other hand, a sheet ejection roller pair 15 to eject the sheet outside the apparatus and a sheet discharge tray 16 to stack the sheet ejected by the sheet ejection roller pair 15 outside the apparatus, are disposed above the apparatus body 100.

A conveyance path R through which the sheet P is conveyed from the paper tray 13 via the secondary transfer nip to the sheet discharge tray 16 is disposed inside the apparatus body 100. A pair of registration rollers 17 to convey the sheet P to the secondary transfer nip at an appropriate timing is disposed upstream of the secondary transfer roller 12 in the sheet conveyance direction in the conveyance path R. The fuser device 18 to fix an unfixed image onto the sheet P is disposed downstream of the secondary transfer roller 12 in the sheet conveyance direction.

Next, again with reference to FIG. 1, basic operation of the printer according to an embodiment of the present invention will be described.

When an image forming operation is started by an image formation start signal from a host device (not shown), each photoreceptor 2 of each of the processing units 1Y. 1M, 1C, and 1Bk is driven to rotate in the counterclockwise direction as illustrated in FIG. 1, and each surface of the photoreceptor 2 is uniformly charged at a predetermined polarity by the charger 3. Then, the exposure means 5 irradiates the charged surface of each photoreceptor 2 with laser beams based on the image data, to thus form an electrostatic latent image on the surface of each photoreceptor 2. In this case, the image data exposed on each photoreceptor 2 is monochrome image data decomposed, from the target full-color image, into color data of yellow, magenta, cyan, and black. Each developing device 4 supplies toner to the electrostatic latent image formed on the photoreceptor 2, and the electrostatic latent image is visualized as a toner image.

When the image forming operation is started, the drive roller 9 that is stretched around the intermediate transfer belt 8 is driven to rotate and the intermediate transfer belt 8 is driven to rotate in the direction indicated by an arrow in the figure. In addition, because the constant voltage or the constant-current controlled voltage with a polarity opposite that of the toner is applied to each of the primary transfer rollers 11, a transfer electric field is formed at the primary transfer nip between each of the primary transfer rollers 11 and each photoreceptor 2.

Thereafter, upon the toner image of each color formed on the photoreceptor 2 reaching the primary transfer nip associated with the rotation of each photoreceptor 2, the toner image of each color formed on each photoreceptor 2 is sequentially transferred in a superposed manner on the intermediate transfer belt 8 by the transfer electric field formed at the primary transfer nip. Thus, a full-color toner image is carried on the surface of the intermediate transfer belt 8. In addition, the residual toner which has not been transferred to the intermediate transfer belt 8 is removed by the not-shown cleaning unit.

The sheet feed roller 14 disposed in the bottom of the apparatus body 100 is started to rotate so that the sheet P is fed out from the paper tray 13 to the conveyance path R. The sheet P fed out to the conveyance path R is once stopped by a registration roller pair 17.

Then, the registration roller pair 17 starts to rotate at a predetermined timing, so that the sheet P is conveyed to the secondary transfer nip at a matched timing with which the toner image on the intermediate transfer belt 8 has reached the secondary transfer nip. In this case, because the transfer voltage having a polarity opposite that of the charged toner of the toner image on the intermediate transfer belt 8 is applied to the secondary transfer roller 12, a transfer electric field is formed at the secondary transfer nip. Through the electric transfer field formed at the secondary transfer nip, the toner image on the intermediate transfer belt 8 is transferred en bloc to the sheet P.

Thereafter, the sheet P on which the toner image has been transferred is conveyed to the fuser device 18 and the toner image on the sheet P is fixed onto the sheet P. The sheet P is then discharged outside the apparatus by the sheet ejection roller pair 15 and is stacked on the sheet discharge tray 16.

The description heretofore relates to an image forming operation when a full-color image is formed on the sheet; alternatively, however, a monochrome image may be formed using any one of the four processing units 1Y, 1M, 1C, and 1Bk, and an image formed of two or three colors may be formed by using two or three processing units.

Figure 2:
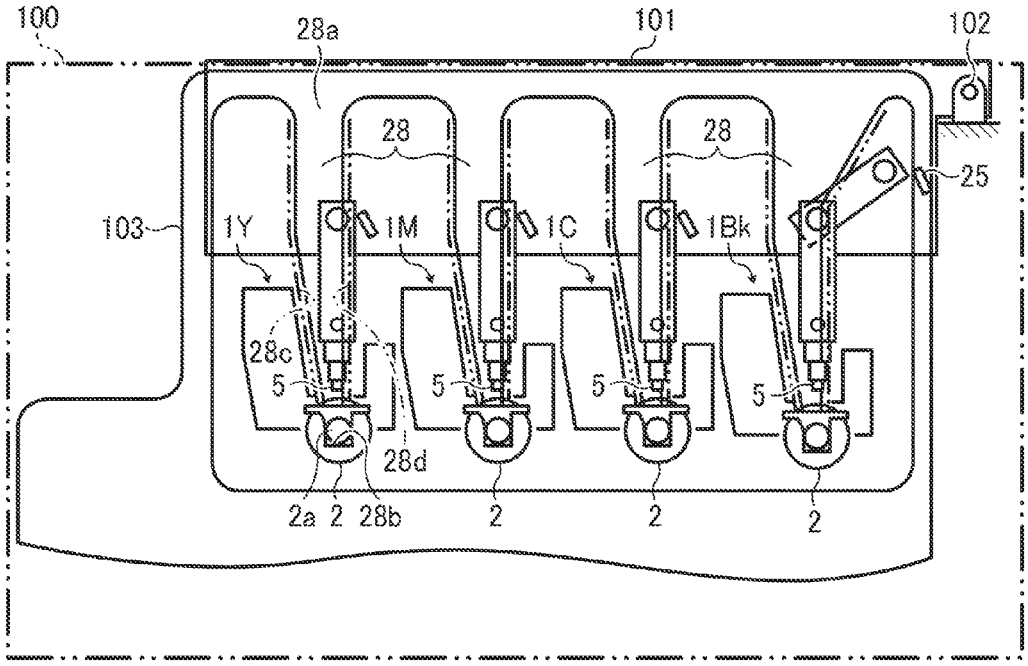
FIG. 2 is a cross-sectional side view of the printer when a cover is open.
Figure 3:
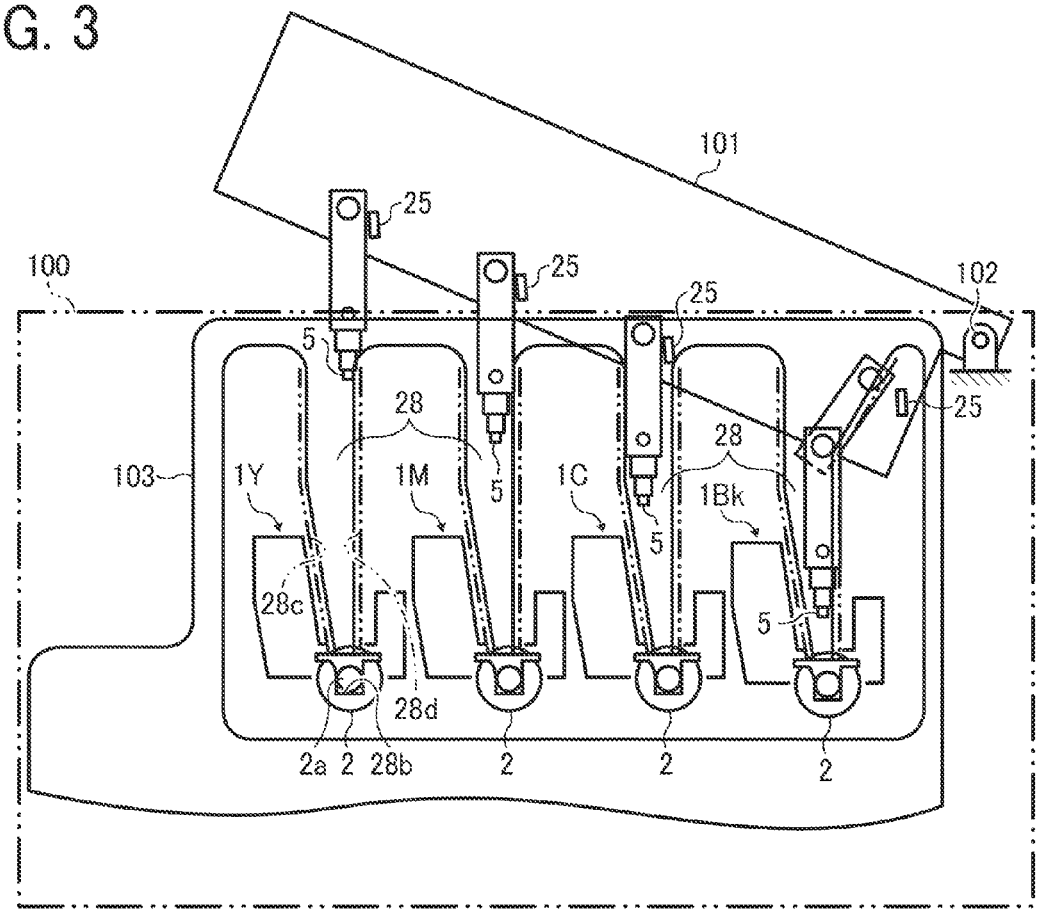
FIG. 3 is a cross-sectional side view of the printer when the cover is half-open.
Figure 4:
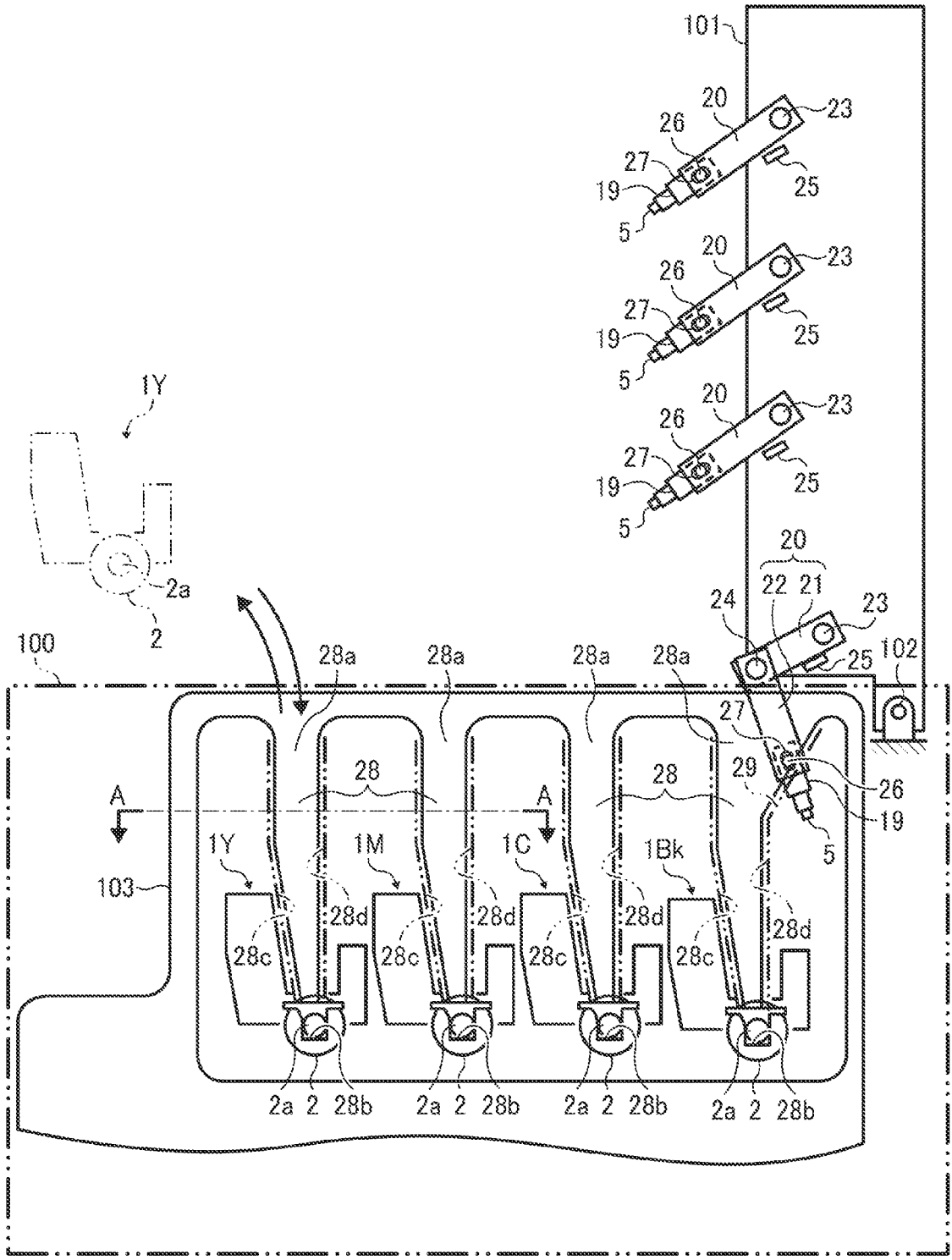
FIG. 4 is a cross-sectional side view of the printer when the cover is fully open.
Figure 5:
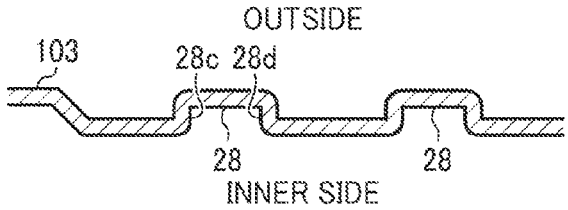
FIG. 5 is a cross-sectional view along Line A-A of FIG. 4.

In addition, as illustrated in FIGS. 2 to 4, an openably closable cover 101 is disposed on the apparatus body 100. FIG. 2 is a cross-sectional side view of the printer when a cover is closed; FIG. 3 is a cross-sectional side view of the printer when the cover is half-open; and FIG. 5 is a cross-sectional side view of the printer when the cover is fully open.

The cover 101 is mounted on a support shaft 102 as a hinge laterally disposed above the apparatus body 100, and is openable by rotating about the support shaft 102. In addition, the plurality of optical writing heads 5 is disposed on the cover 101 so that each optical writing head 5 moves associated with an open/close operation of the cover 101.

As illustrated in FIG. 4, if the cover 101 is rotated upward to render the apparatus open and exposed, each optical writing head 5 can be retracted from the exposure position above and near the photoreceptor 2. Thus, by moving each optical writing head 5 to the retracted position from the exposure position, the processing units 1Y, 1M, 1C, and 1Bk, being consumables, can be removed from the apparatus body 100 from above without interference from the optical writing heads 5.

In addition, side plates 103 are disposed at lateral ends of the apparatus body 100. Each side plate 103 includes a plurality of guide grooves 28 to guide each of the processing units 1Y, 1M, 1C, and 1Bk in mounting to the apparatus. Each guide groove 28 extending vertically is formed on an interior wall of the side plate 103. A rotary shaft 2*a* of the photoreceptor 2 is inserted into the guide groove 28 from above. As a result, each guide groove 28 has an upper end 28*a* that is open upward, so that the rotary shaft 2*a* can be inserted.

As illustrated in FIG. 5 which is a cross-sectional view along Line A-A of FIG. 4, each guide groove 28 includes guide surfaces 28*c* and 28*d*, facing each other. When the processing units 1Y, 1M, 1C, and 1Bk are installed in the apparatus, the rotary shaft 2*a* of the photoreceptor 2 contacts one of the guide surfaces 28*c* and 28*d* to guide the processing units 1Y, 1M, 1C, and 1Bk into the apparatus. In addition, a lower portion 28*b* of each guide groove 28 defines a positioning part: When the rotary shaft 2*a* of the photoreceptor 2 contacts the lower portion 28*b*, the processing unit 1Y, 1M, 1C, or 1Bk is securely positioned.

In the present embodiment, each guide groove 28 is formed in a single member. Specifically, the side plate 103 is formed of a single metal plate, the convex-concave shape of which is obtained by spinning, and the concave portion is the guide groove 28.

Next, referring to FIG. 4, how to mount the optical writing head 5 to the cover 101 will be described.

As illustrated in FIG. 4, each optical writing head 5 is supported and held by a head holder 19 serving as a support member. Each head holder 19 is mounted to an interior surface of the cover 101 via an arm member 20. The arm member 20 has a rotary shaft 23 or two rotary shafts 23 and 24 each substantially parallel to the support shaft 102 of the cover 101.

Herein, the plurality of optical writing heads 5 is disposed each at a different position with a different distance from the support shaft 102 of the cover 101. Among the plurality of optical writing heads 5, three optical writing heads 5 including the farthest from the support shaft 102 of the cover 101 to the third farthest therefrom are mounted to the cover 101 via the arm member 20 having one rotary shaft 23. Accordingly, these optical writing heads 5 are held by the arm member 20, one end of which is mounted to the interior surface of the cover 101 via the first rotary shaft 23, and the head holder 19 mounted to the other end of the arm member 20.

By contrast, the optical writing head 5 closest to the rotary shaft 102 of the cover 101 is mounted to the cover 101 via the arm member 20 having two rotary shafts 23 and 24. Specifically, the optical writing head 5 is held by a first arm member 21 one end of which is mounted to the interior surface of the cover 101 via the rotary shaft 23; a second arm member 22, one end of which is mounted to the other end of the first arm member 21 via the second rotary shaft 24; and the head holder 19 mounted to the other end of the second arm member 22.

The cover 101 is provided with a stopper 25 in the vicinity of each arm member 20. As illustrated in FIG. 4, when the cover 101 is left open, each stopper 25 contacts each arm member 20 to restrict its rotation so that each optical writing head 5 is stabilized at a predetermined orientation.

Figure 6:
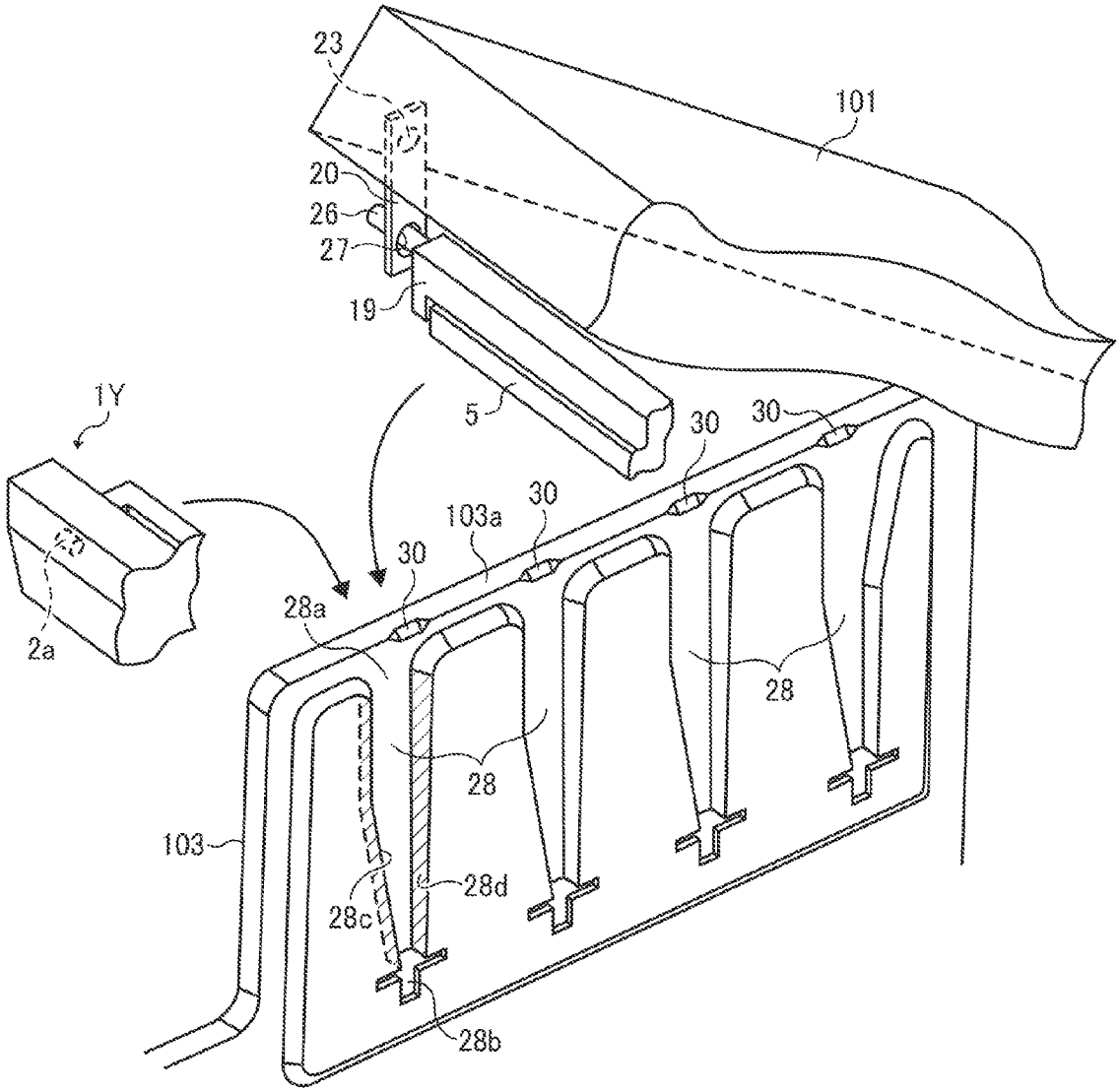
FIG. 6 is a perspective view of the printer when the cover is half-open.

FIG. 6 is a perspective view of the printer when the cover is half-open.

As illustrated in FIG. 6, the head holder 19 is formed into a longitudinal shape similar to the optical writing head 5. A cylindrical projection 26 is disposed at a longitudinal end of the head holder 19, and the projection 26 is inserted into a slot 27 formed in the arm member 20. The cylindrical projection 26 is disposed at another longitudinal end of the head holder 19 although not illustrated in FIG. 6. The projection 26 at an opposite end is inserted into another slot 27 of the arm member 20.

FIG. 6 shows an exemplary structure to mount the head holder 19 and the arm member 20 holding the optical writing head 5 which is farthest from the support shaft 102 of the cover 101; alternatively, however, the mounting of the other head holders 19 and arm members 20 may be similar to the illustrated example.

As described above, the head holder 19 is mounted such that the projection 26 is inserted into the slot 27 formed in the arm member 20 of the second arm member 22. Further, rotation around the projection 26 is restricted by a regulation means, not shown, thereby preventing the head holder 19 from rotating excessively. However, the rotation of the head holder 19 is not completely restricted and a slight rotation of the head holder 19 admissible for positional adjustment is allowed when the optical writing head 5 is positioned relative to the photoreceptor 2.

From a state illustrated in FIG. 4, when the cover 101 is closed, each optical writing head 5 is allocated to an exposure position in the vicinity of each photoreceptor 2. In this case, the guide groove 28 serves as a guide member to guide each optical writing head 5 to each exposure position. In the present embodiment, because the projection 26 of the head holder 19 moves along the guide groove 28, each optical writing head 5 is guided. More specifically, as illustrated in FIG. 3, along with the closing operation of the cover 101, each arm member 20 rotates under its own weight to thus release the contacting state with the stopper 25. The optical writing head 5 is guided such that each projection 26 of the head holder 19 is inserted from the upper end 28*a* of the corresponding guide groove 28 and moves along the guide surface 28*d* closer to the support shaft 102 of the cover 101.

Figure 7:
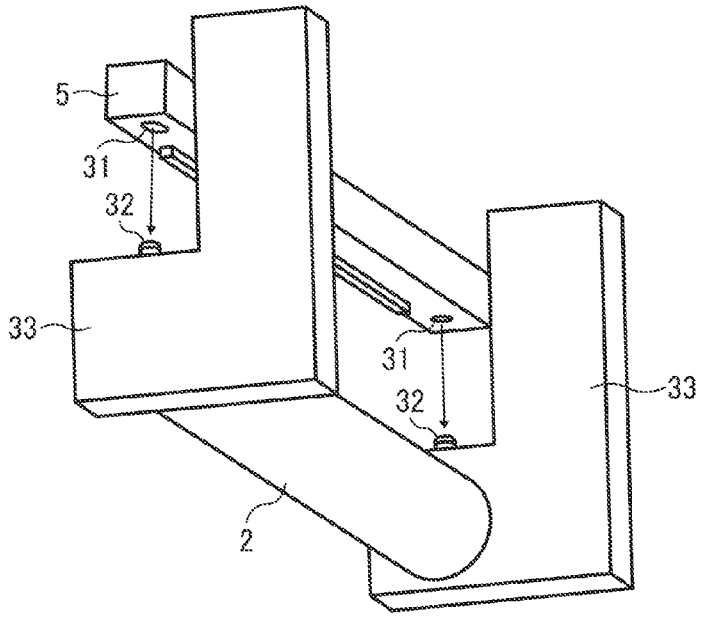
FIG. 7 is a view illustrating a positioning device to position an optical writing head relative to the photoreceptor.

FIG. 7 is a view illustrating a positioning device to position an optical writing head relative to the photoreceptor.

As illustrated in FIG. 7, the positioning device includes recesses 31 disposed on the optical writing head 5 and projections 32 disposed on the photoreceptor 2. The recesses 31 are disposed at both lateral ends of the longitudinal optical writing head 5, and the projections 32 are disposed at a case 33 of the processing unit that holds the lateral ends of the photoreceptor 2. The recesses 31 and the projections 32 are engageable and disengage-able each other in a direction in which the optical writing head 5 is guided by the guide groove 28. Accordingly, when the cover 101 is closed, because the projections 32 are inserted into the recesses 31, the optical writing head 5 is positioned at a position close to the photoreceptor 2. Alternatively, the projections 32 may be disposed at the optical writing head 5 and the recesses 31 can be disposed at the photoreceptor 2.

Among the arm members 20, the arm member 20 closest to the support shaft 102 of the cover 101 is configured to rotate about two rotary shafts. Corresponding to this different structure, the shape of the guide groove 28 for the closest arm member 20 is also different. Specifically, among the plurality of guide grooves 28 positioned at different distances from the support shaft 102 of the cover 101, the guide groove 28 closest to the support shaft 102 alone is provided with a slanted portion 29 slanting toward the closing direction of the cover 101 and away from the support shaft 102 of the cover 101 (see FIG. 4).

Figure 8:
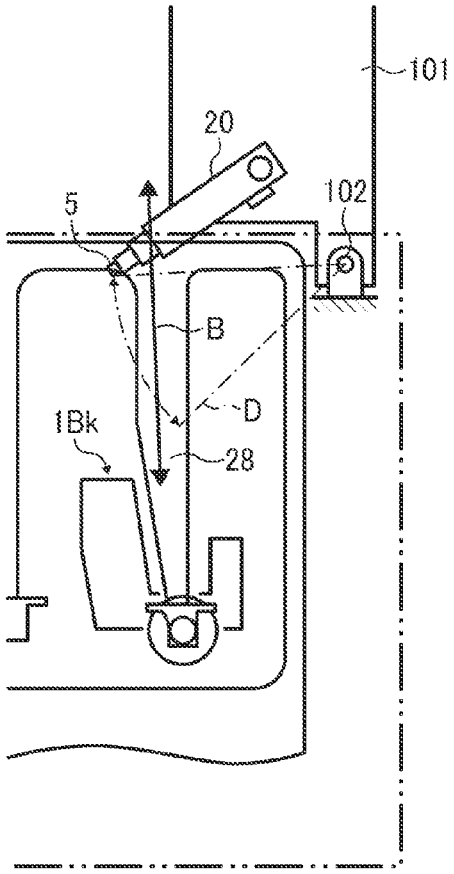
FIG. 8 shows a structure to rotate an arm member closest to an axis of the cover about the axis alone.

If the guide groove 28 and the arm member 20 closest to the support shaft 102 of the cover 101 are constructed similarly to the other members, because the arm member 20 is allocated on an engagement/disengagement path B of the processing unit 1Bk as illustrated in FIG. 8, the arm member 20 interferes with the processing unit 1Bk when the processing unit 1Bk is to be replaced, for example. To solve this problem, the support shaft 102 of the cover 101 is preferably disposed at a position away from the guide groove 28 and a radius D of the moving locus of the arm member 20 is made larger. However, if the support shaft 102 of the cover 101 is positioned away from the guide grooves 28, the size of the apparatus increases, in particular, toward the direction intersecting the support shaft 102 of the cover 101.

Then, according to the present embodiment, the arm member 20 closest to the support shaft 102 of the cover 101 is rotatably configured about two shafts, so that the arm member 20 and the optical writing head 5 can be retracted at positions not interfering with the engagement/disengagement path of the processing unit 1Bk (see FIG. 4). Further, by providing the slanted portion 29 on the guide groove 28 closest to the support shaft 102 of the cover 101, two-shaft rotatable arm member 20 and the optical writing head 5 held by the arm member 20 can be guided to the exposure position smoothly. As a result, without providing the support shaft 102 of the cover 101 at a position away from the guide grooves 28, the processing unit 1Bk can be attached and detached without interfering with the arm member 20, thereby eliminating the need for a larger apparatus body. In addition, the arm member 20 closest to the support shaft 102 of the cover 101 is not limited to the two-shaft rotatable structure, but can be rotatable about more than three shafts.

Further, as illustrated in FIG. 6, in the present embodiment, a plurality of chamfers 30 are formed on an upper surface 103*a* of the side plate 103. Each chamfer 30 is disposed above a corresponding guide groove 28 and is slanted toward the guide groove 28 from an outer to an inner side. As a result, when the cover is closed, even though the optical writing head 5 oscillates in the longitudinal direction and the projection 26 of the head holder 19 displaces outward, the projection 26 contacts the chamfer 30 and is guided inward, so that the projection 26 is prevented from getting caught on the side plate 103. As a result, the optical writing head 5 can be guided into the guide groove 28 smoothly.

As described heretofore, the guide groove 28 serves as a guide member for both the optical writing head 5 and the processing units 1Y, 1M, 1C, and 1Bk. As a result, without providing a guide for the exposure means and a guide for the image formation unit separately, erroneous installation of the image formation unit in the guide member for the exposure means can be prevented.

Further, in the present embodiment, the guide groove 28 is formed in a single member, unlike in the case of the image forming apparatus according to JP-3504170-B, which includes guide grooves formed of two members, which may prevent smooth guiding operation, and damage the parts or components. By contrast, because the guide grooves 28 of the present embodiment are formed in as single member, there is no step, thereby realizing a smooth guiding operation and preventing damage to the parts or components. Furthermore, the number of parts is reduced.

In the present embodiment, the guide groove 28 is formed in a steel plate subjected to a spinning process, in which strength is particularly improved because the concavo-convex shape is created by the spinning process applied to the metal plate. In addition, the apparatus can be made slimmer. In addition, the guide groove 28 may be integrally formed using resins.

Further, according to the present embodiment, because the arm member 20 and the guide groove 28 closest to the support shaft 102 of the cover 101 are formed differently from the other members, detachability of the processing unit is secured, the apparatus is prevented from becoming large, and the optical writing head 5 can be smoothly guided.

In addition to the examples described in the above embodiments, for example, the guide member used for both the processing unit and the exposure means can be formed into a shape other than the groove. Further, a concave portion is formed at the processing unit or the exposure means, and the guide member is formed into a rail or a convex portion to be inserted into the corresponding concave portion.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an apparatus body;

a rotatable image carrier including a rotary shaft;

an exposure device configured to form a latent image through exposure of a surface of the image carrier and retractable from an exposure position;

an image formation unit disposed detachably from the apparatus body;

a guide member to guide the exposure device to the exposure position, the guide member being used both to guide the image formation unit to the apparatus body and to guide the exposure device to the exposure position; and a support member including a projection, wherein the image formation unit includes at least the rotatable image carrier, the exposure device is supported by the support member including the projection, and the guide member includes a guide groove in which the rotary shaft of the image carrier and the projection can be inserted.

2. The image forming apparatus as claimed in claim 1, wherein the exposure device is an optical writing head to expose the surface of the image carrier from a position in the vicinity of the image carrier and form a latent image thereon.

3. The image forming apparatus as claimed in claim 1, wherein the guide member is formed of a single member.

4. The image forming apparatus as claimed in claim 3, wherein the guide member is a metal plate disposed on the apparatus body.

5. The image forming apparatus as claimed in claim 3, wherein the guide member is formed from resinous materials.

6. An image forming apparatus comprising:

an apparatus body;

a rotatable image carrier including a rotary shaft;

an exposure device configured to form a latent image through exposure of a surface of the image carrier and retractable from an exposure position;

an image formation unit disposed detachably from the apparatus body;

a guide member to guide the exposure device to the exposure position, the guide member being used both to guide the image formation unit to the apparatus body and to guide the exposure device to the exposure position; and an openably closable cover, rotatably about a support shaft relative to the apparatus body, wherein the exposure device is rotatably disposed on the cover and is configured to move between the exposure position and a retracted position.

7. The image forming apparatus as claimed in claim 6, wherein a plurality of exposure devices and a plurality of guide members are disposed at different distances from the support shaft of the cover, wherein an exposure device closest to the support shaft of the cover is mounted to the cover via a plurality of rotary shafts.

8. The image forming apparatus as claimed in claim 7, wherein the guide member closest to the support shaft of the cover includes a slanted portion slanting toward a closing direction of the cover and away from the support shaft of the cover.

9. An image forming apparatus comprising:

an apparatus body;

a rotatable image carrier including a rotary shaft;

an exposure device configured to form a latent image through exposure of a surface of the image carrier and retractable from an exposure position;

an image formation unit disposed detachably from the apparatus body; and a guide member to guide the exposure device to the exposure position, the guide member being used both to guide the image formation unit to the apparatus body and to guide the exposure device to the exposure position, wherein the guide member includes a chamfer disposed above a corresponding guide groove and configured to prevent the exposure device from getting caught on the apparatus body when the exposure device enters the guide member.

* * * * *